US006768254B2

(12) United States Patent
Arakawa et al.

(10) Patent No.: US 6,768,254 B2
(45) Date of Patent: Jul. 27, 2004

(54) SELF-BALLASTED ELECTRODELESS DISCHARGE LAMP AND ELECTRODELESS DISCHARGE LAMP

(75) Inventors: Takeshi Arakawa, Kyoto (JP); Mitsuharu Kawasaki, Kadoma (JP); Kiyoshi Hashimotodani, Takatsuki (JP); Kenichiro Takahashi, Katano (JP); Koji Miyazaki, Hirakata (JP); Katsushi Seki, Kurita-gun (JP); Toshiaki Kurachi, Hirakata (JP); Kenji Itaya, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/133,174

(22) Filed: Apr. 26, 2002

(65) Prior Publication Data

US 2002/0158567 A1 Oct. 31, 2002

(30) Foreign Application Priority Data

Apr. 26, 2001 (JP) ..... 2001-128866

(51) Int. Cl.[7] ..... H01J 1/62; H01J 63/04

(52) U.S. Cl. ..... 313/493; 313/485; 313/318.01; 313/318.05; 313/318.1

(58) Field of Search ..... 313/493, 313, 313/485, 318.01, 318.05, 318.09, 318.1, 492

(56) References Cited

U.S. PATENT DOCUMENTS

| | | | | |
|---|---|---|---|---|
| 2,157,051 A | | 5/1939 | Birdseye | 439/615 |
| 4,298,828 A | * | 11/1981 | Justice et al. | 315/248 |
| 4,920,297 A | | 4/1990 | van der Heijden et al. | 313/315 |
| 5,461,284 A | * | 10/1995 | Roberts et al. | 315/57 |
| 5,668,433 A | * | 9/1997 | Everest et al. | 313/313 |
| 5,698,951 A | * | 12/1997 | Maya et al. | 315/248 |
| 5,808,414 A | * | 9/1998 | Wharmby et al. | 313/607 |

FOREIGN PATENT DOCUMENTS

| | | |
|---|---|---|
| JP | 62-262302 | 11/1987 |
| JP | 06-196006 | 7/1994 |
| JP | 07-014551 A | 3/1995 |
| JP | 07073714 A | 3/1995 |
| JP | 07-211298 | 8/1995 |
| JP | 08212981 A | 8/1996 |
| JP | 8-511650 | 12/1996 |
| JP | 09320541 A | 12/1997 |
| JP | 11040110 A | 2/1999 |
| WO | WO 95/27995 | 10/1995 |

* cited by examiner

*Primary Examiner*—Vip Patel
*Assistant Examiner*—Kevin Quarterman
(74) *Attorney, Agent, or Firm*—Harness, Dickey & Pierce, P.L.C.

(57) ABSTRACT

A self-ballasted electrodeless discharge lamp includes a discharge vessel having a cavity, an induction coil that is inserted into the cavity, a ballast for supplying power to the induction coil, a case for covering the ballast, and a lamp base provided in the case. The discharge vessel is secured to the case via a holder. A part of the discharge vessel and a first portion of the holder are engaged with each other to constitute a combination structure. A second portion of the holder and a part of the case are engaged with each other to constitute a combination structure.

8 Claims, 9 Drawing Sheets

SELF-BALLASTED ELECTRODELESS DISCHARGE LAMP AND ELECTRODELESS DISCHARGE LAMP

BACKGROUND OF THE INVENTION

The present invention relates to an electrodeless discharge lamp, in particular, a self-ballasted electrodeless discharge lamp.

In recent years, maintenance-free electrodeless discharge lamps (hereinafter, referred to as "electrodeless fluorescent lamps") having a long life that is provided with a phosphor layer inside the lamp have been put to practical use and been under development. Lamps of this type are not provided with electrodes inside the discharge vessel, and discharge occurs in the following manner: a luminous material in the discharge vessel is electromagnetically coupled by high frequency electromagnetic field generating means for generating an electromagnetic field inside the discharge vessel enclosing the luminous material so that a closed loop discharge is formed. The ultraviolet rays that are generated by this discharge are converted to visible light by the phosphor applied onto the inner surface of the discharge vessel. In general, the high frequency electromagnetic field generating means is, for example, an exciting coil through which a high frequency current flows.

Since electrodeless fluorescent lamps include no electrodes inside the discharge vessel, they operate regardless of depletion of an emissive material applied onto electrodes on which the life of a fluorescent lamp depends. Therefore, the electrodeless fluorescent lamps are characterized by having a long life.

Conventionally, in the electrodeless fluorescent lamps, a heat-resistant adhesive such as silicone is poured into a portion where a discharge vessel is in contact with a case for housing a high frequency power connected to an exciting coil to secure the discharge vessel to the case. This method is used, especially for self-ballasted fluorescent lamps with electrodes having a life of about 6000 hours.

However, this method causes detachment of the adhesive because of the contraction of the adhesive due to the heat of the discharge vessel or decrease of the adhesion strength between the discharge vessel and the case due to the degradation or change in quality of the adhesive over time. In particular, since the electrodeless fluorescent lamps have long lives, the decrease of the adhesion strength is particularly problematic.

In order to solve these problems, Japanese Laid-Open Patent Publication No. 9-320541 discloses a technique for compensating for the decrease of the adhesion strength by providing a recess or a protrusion that is engaged with each other in a case and a discharge vessel in a portion in which the case including a ballast is in contact with the discharge vessel.

FIGS. 10A and 10B show the electrodeless fluorescent lamp disclosed in the above publication. FIG. 10A is a cross-sectional view of the entire electrodeless discharge lamp, and FIG. 10B is an enlarged view of the portion where the case is in contract with the discharge vessel. In the drawing, reference numeral 101 denotes a discharge vessel, 102 denotes a phosphor, 303 denotes a translucent conductive film, 304 denotes a regular incandescent lamp base, 305 denotes a blast, 306 denotes ferrite, 307 denotes an exciting coil, 308 is a case cover, 309 denotes a protrusion and 210 denotes a recess.

In the method of engaging the discharge vessel to the case with the recess and the protrusion as shown in FIGS. 10A and 10B, the discharge vessel and the case are engaged with each other directly, so that it is necessary that the discharge vessel matches the shape of the case. On the other hand, the size of the case is determined by the magnitude of the high frequency power to be housed. Thus, the degree of freedom in the design of the shape of the discharge vessel that affects the discharge characteristics significantly may be restricted by the size of the case.

Furthermore, in the above method, there is nothing between the discharge vessel and the high frequency power enclosed in the case, visible light generated in the discharge vessel leaks to the high frequency power or the inside of the case, so that the ratio of the light that can be utilized for effective illumination of an object with respect to the light generated in the discharge vessel (hereinafter, referred to as "light utilization efficiency") is insufficient and the light utilization efficiency is low.

SUMMARY OF THE INVENTION

Therefore, with the foregoing in mind, it is a main object of the present invention to provide an electrode discharge lamp in which the decrease of the adhesion strength between the discharge vessel and the case is suppressed. It is another object to provide an electrodeless discharge lamp in which the light utilization efficiency is improved.

A first self-ballasted electrodeless discharge lamp of the present invention includes a discharge vessel having a cavity, an induction coil that is inserted into the cavity, a ballast for supplying power to the induction coil, a case for covering the ballast; and a lamp base provided in the case. The discharge vessel is secured to the case via a holder. A part of the discharge vessel and a first portion of the holder are engaged with each other to constitute a combination structure. A second portion of the holder and a part of the case are engaged with each other to constitute a combination structure.

It is preferable that at least a part of the holder on the side of the discharge, vessel has a function of reflecting light from the discharge vessel.

It is preferable that at least a part of the holder has a function of shielding a magnetic field from the discharge vessel.

A second self-ballasted electrodeless discharge lamp of the present invention includes a discharge vessel having a cavity, an induction coil that is inserted into the cavity, a ballast for supplying power to the induction coil, a case for covering the ballast, and a lamp base provided in the case. The discharge vessel is secured to the case via a holder. The induction coil includes a core and a winding. The holder has a cylindrical bobbin portion whose surface is wound with the winding and into which the core is inserted. A part of the discharge vessel and a first portion of the holder are engaged with each other to constitute a combination structure. A second portion of the holder and a part of the case are engaged with each other to constitute a combination structure.

In one preferable embodiment, a first end of the core is positioned in the case, and a heat sink is provided in the first end of the core.

A third self-ballasted electrodeless discharge lamp of the present invention includes a discharge lamp having a cavity, an induction coil that is inserted into the cavity, a ballast for supplying power to the induction coil, a case for covering the ballast, and a lamp base provided in the case. The discharge vessel is secured to the case via a holder. A part of the discharge vessel and a first portion of the holder are engaged with each other to constitute a combination structure. A second portion of the holder and a part of the case are engaged with each other to constitute a combination structure. The holder has a circuit holder portion on which the ballast is placed.

In one preferable embodiment, the induction coil includes a core and a winding. The holder has a cylindrical bobbin portion whose surface is wound with the winding and into which the core is inserted. A first end of the core is positioned in the case, and a heat sink is provided in the first end of the core.

In one preferable embodiment, the part of the discharge vessel is a protrusion extending to a second direction substantially perpendicular to a first direction, the induction coil being inserted in the first direction. The first portion of the holder is a recess that clamps the protrusion and has a substantially U-shaped cross section. A notched portion having a size that allows the protrusion to move in a direction substantially perpendicular to the second direction is provided in a periphery of the recess of the holder. The holder has an engagement structure that allows the protrusion to be engaged with the recess by inserting the protrusion of the discharge vessel to the notched portion of the holder, and then rotating the discharge vessel around a portion into which the induction coil is inserted.

In one preferable embodiment, the second portion of the holder is a protrusion. A part of the case is a wedge shaped portion that supports the protrusion after the protrusion of the holder is inserted to a direction opposite to the discharge vessel.

An electrodeless discharge lamp of the present invention includes a discharge vessel having a first shape in which a luminous material is enclosed, high frequency electromagnetic field generating means for generating discharge inside the discharge vessel, a holder having a second shape and a third shape, and a case having a fourth shape. The electrodeless fluorescent lamp has a structure in which the first shape and the second shape are engaged, and a structure in which the third shape and the fourth shape are engaged.

In one preferable embodiment, the holder has at least one function selected from the group consisting of a function of reflecting light from the holder and a function of shielding a magnetic field from the discharge vessel.

In one preferable embodiment, the second shape is a wedge-like shape having elasticity.

In one preferable embodiment, the second shape is a threading groove structure.

In one preferable embodiment, at least one of the third shape and the fourth shape is a wedge-like shape having elasticity.

In one preferable embodiment, at least one of the third shape and the fourth shape is a threading groove structure.

The holder may be constituted with at least two parts.

According to the present invention, the discharge vessel is secured to the case via the holder, and the present invention has a combination structure in which a part of the discharge vessel and the first portion are engaged with each other, and the second portion of the holder and a part of the case are engaged with each other. Therefore, the decrease in the adhesion strength between the discharge vessel and the case can be suppressed.

DETAILED DESCRIPTION OF THE INVENTION

Hereinafter, embodiments of the present invention will be described with reference to the accompanying drawings. In the following drawings, the components having substantially the same function bear substantially the same numeral for simplification of description. However, the present invention is not limited to the following embodiments.

Embodiment 1

Figure 1:
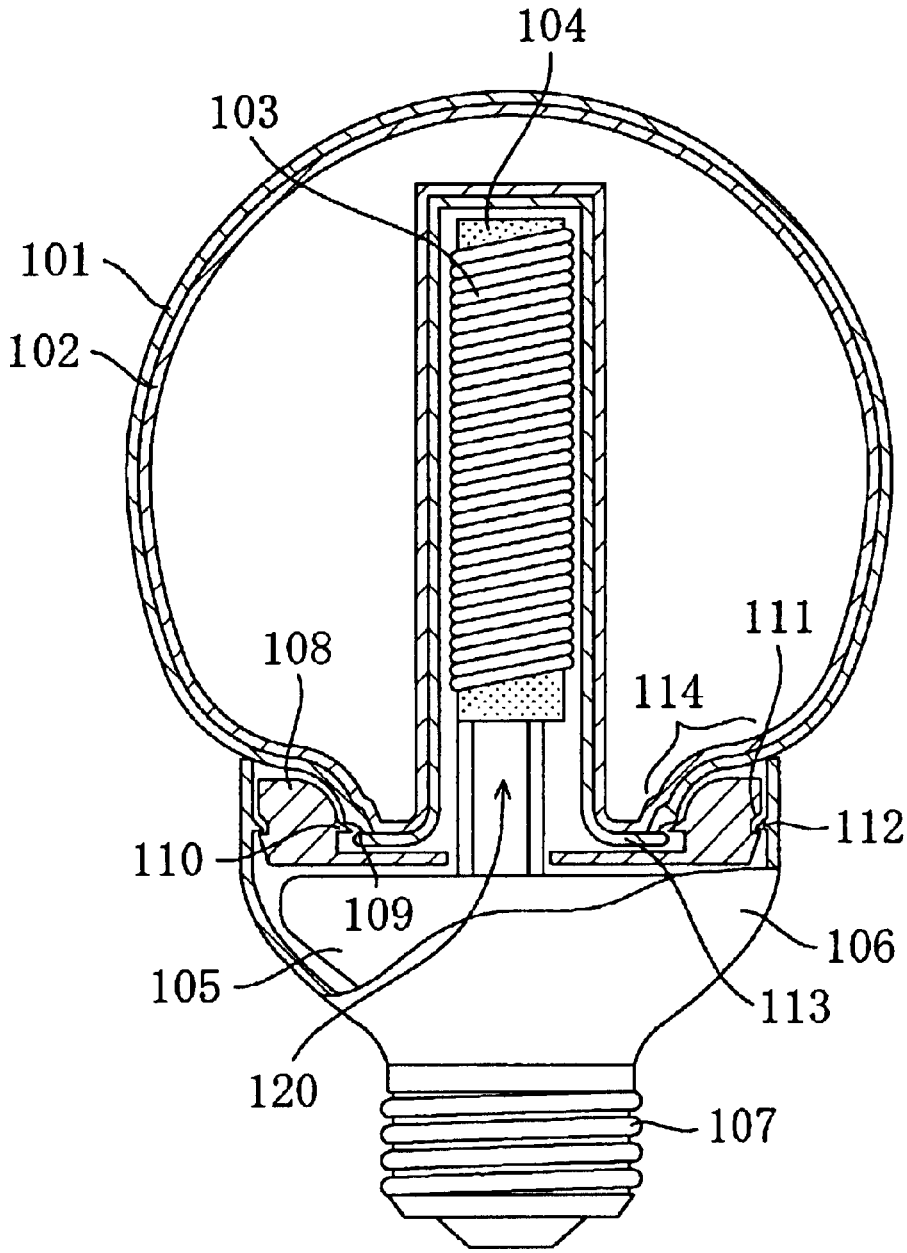
FIG. 1 is a partially cutaway cross-sectional view of an electrodeless fluorescent lamp of Embodiment 1 of the present invention.

FIG. 1 is a partially cutaway cross-sectional view of an electrodeless fluorescent lamp of Embodiment 1. The electrodeless discharge lamp shown in FIG. 1 is a self-ballasted electrodeless discharge lamp to which power can be supplied through a lamp base and that includes a ballast inside. This self-ballasted electrodeless discharge lamp includes a discharge vessel (bulb) 101 having a cavity 120, an induction coil (103 and 104) that is inserted into the cavity 120, a ballast 105 for supplying power to the induction coil, a case 106 for covering the ballast 105, and a lamp base 107 provided in the case 106. The induction coil serves as high frequency electromagnetic field generating means for generating a high frequency electromagnetic field in the discharge vessel 101 and are constituted with a core 104 made of a soft magnetic material (e.g., ferrite) and a coil (exciting coil) 103 wound around the core 104. The coil 103 is electrically connected, and the ballast 105 is electrically connected to the lamp base 107.

In this embodiment, the discharge vessel 101 is secured to the case 106 via a holder 108. A part 109 of the discharge vessel 101 and a first portion 110 of the holder 108 are engaged with each other to form a combination structure, and a second portion 111 of the holder 108 and a part 112 of the case 106 are engaged with each other to a form a combination structure. In the structure shown in FIG. 1, the holder 108 and the discharge vessel 101 are engaged with each other at a recess 109 and a protrusion 110 so that they are secured to each other firmly. The holder 108 and the case 106 are also engaged with each other at the recess 111 and the protrusion 112 so that they are secured to each other firmly.

Next, the structure of this embodiment will be described further in detail. The discharge vessel 101 is a substantially spherical vessel made of glass in which mercury as a luminous material and a rare gas (e.g., krypton or argon) as a buffer gas are enclosed inside. In the discharge vessel 101, mercury is enclosed in the form of liquid or amalgam and heated by plasma during operation so as to create a vapor pressure defined by that temperature. The inner volume of the discharge vessel 101 is, for example, 100 to 270 $cm^3$, and 2 to 10 mg of mercury and krypton with a filling pressure of 50 to 300 Pa (at the time of a temperature of 25° C.) are enclosed. It is possible to configure an electrodeless fluorescent lamp free from mercury in which mercury is not enclosed as a luminous material.

A phosphor 102 is applied onto the inner side (inner wall) of this discharge vessel 101 for converting the UV rays generated by discharge in the discharge vessel 101 to visible light. As described above, the cavity (recess) 120 into which a part of the high frequency electromagnetic field generating means (induction coil portion) is inserted is formed in a part of the discharge vessel 101, and therefore the high frequency electromagnetic field generating means can be disposed in the vicinity of the discharge vessel 101 easily. The discharge vessel 101 having such a cavity 120 includes a cylindrical inner bulb in which the exciting coil 103 can be disposed, and a substantially spherical outer bulb to which the phosphor 102 is applied. The discharge vessel 101 can be formed by fusing a flare 113 of the inner bulb to a part of the outer bulb with a flame of a burner or the like.

Illustrative sizes of the discharge vessel 101 in this embodiment are as follows. The outer diameter of the center of the discharge vessel 101 (i.e., the outer diameter of the largest portion) is 50 to 90 mm (thickness of about 1 mm), and the discharge vessel 101 is made of, for example, soda lime glass. The height of the discharge vessel 101 and the height of the electrodeless fluorescent lamp including the lamp base 107 are, for example, 60 to 80 mm and 130 to 240 mm, respectively. The inner diameter of the cavity 120 of the discharge vessel 101 is, for example, 16 to 26 mm.

Since the ballast 105 connected to the exciting coil 103 positioned in the cavity 120 supplies a high frequency power to the exciting coil 103, the ballast 105 can be called a high frequency power. In this embodiment, the high frequency electromagnetic field generating means includes the high frequency power 105, the ferrite core 104, and the exciting coil 103 wound around the ferrite core 104. As shown in FIG. 1, the high frequency electromagnetic field generating means (in particular, the exciting coil 103 and the ferrite core 104) are provided substantially in the central portion 120 of the discharge vessel 101 to generate discharge in the discharge vessel 101. That is to say, the ferrite core 104 and the exciting coil 103 are inserted into the cavity 120 of the discharge vessel 101. The high frequency power (ballast) 105 is housed in the case 106 and supplied with power from the outside through the lamp base 107. The lamp base 107 can be threaded into a socket, so that merely threading into a socket allows the electrodeless fluorescent lamp to be electrically connected to an external power (e.g., commercial power)

The high frequency power (ballast) 105 includes electronic components (e.g., semiconductor, capacitor, resistor, coil, etc.) constituting a circuit, and a printed board on which these components are arranged. The case 106 can be made of a heat resistant material, and is made of a heat resistant resin (e.g., polybutylene terephthalate) in this embodiment. In order to improve the heat release properties further, a material having excellent heat conductivity (e.g., metal) can be used to constitute the case 106.

As described above, the discharge vessel 101 is secured to the holder 108. The holder 108 has a disk shape obtained by rotating the cross section shown in FIG. 1 around the ferrite core 104 as the rotation axis. The recess 109 having a first shape is formed in the discharge vessel 101, and is engaged with the protrusion 110 having a second shape formed in the holder 108. Furthermore, the recess 111 having a third shape is formed in the holder 108 and is engaged with the protrusion 112 having a fourth shape of the case 106.

Next, the operation of the electrodeless fluorescent lamp of this embodiment will be described briefly. When a commercial alternating current power is supplied to the high frequency power 105 via the lamp base 107, the high frequency power 105 converts the commercial alternating current power to a high frequency alternating current power, and supplies it to the exciting coil 103. The frequency of the alternating current supplied by the high frequency power 105 is, for example, 50 to 500 kHz, and the power to be supplied is, for example, 5 to 200 W. When the exciting coil 103 is supplied with the high frequency alternating power, a high frequency alternating magnetic field is formed in the space near the coil. Then, an induction field orthogonal to the high frequency alternating magnetic field is generated, and luminous gas inside the discharge vessel 101 is excited for light emission. As a result, light in an ultraviolet ray range or a visible light range is emitted. The emitted light in the ultraviolet ray range is converted to light in a visible light range (visible light) by the phosphor 102 formed on the inner wall of the discharge vessel 101. It is possible to constitute a lamp employing light in an ultraviolet ray range (or light in a visible light range) as it is without forming the phosphor 102. The emission of light in the ultraviolet ray range results mainly from mercury. More specifically, in the case where a high frequency current flows through the induction coil (103 and 104) located close to the discharge vessel 101, the induction magnetic field formed by the lines of magnetic force due to electromagnetic induction cause mercury atoms and electrons in the discharge vessel 101 to collide, so that ultraviolet rays are produced from exited mercury atoms.

Hereinafter, the frequency of alternating current supplied by the high frequency power 105 will be described. In this embodiment, the frequency of alternating current supplied by the high frequency power 105 is in a relatively low frequency region such as 1 MHz or less (e.g., 50 to 500 kHz), compared with 13.56 MHz or several MHz in the ISM band, which is generally used in practice. The reason why the frequency in this low frequency region is used is as follows. First, in operation in a comparatively high frequency region such as 13.56 MHz or several MHz, a noise filter for suppressing line noise generated from the high frequency power 105 is large, so that the volume of the high frequency power 105 becomes large. Furthermore, in the case where noise that is radiated or propagated from the lamp is high frequency noise, a strict regulation for high frequency noise is stipulated by the law. Therefore, in order to meet the regulation, it is necessary to provide an expensive shield, which is detrimental to reduction of the cost. On the other hand, in operation in a frequency region of about 50 kHz to 1 MHz, as the member constituting the high frequency power 105, it is possible to use an inexpensive article for general purposes that is used for an electronic component for general electronic equipment. In addition, it is possible to use a small member, and therefore a reduction in the cost and compactness can be achieved, which provides a large advantage. However, the electrodeless fluorescent lamp of this embodiment can be operated not only at 1 MHz or less, but also in a frequency region of 13.56 MHz or several MHz.

According to the structure of this embodiment, the discharge vessel 101 is mechanically retained in the case 106 via the holder 108, so that an decrease of the adhesion strength between the discharge vessel and the case can be suppressed, compared to a method of securing the discharge vessel 101 and the case 106 only with a heat resistant adhesive such as silicone. In order words, it can be avoided that the adhesion strength between the discharge vessel and the case is decreased by detachment or degradation of the heat resistant adhesion such as silicone due to heat or temporal changes.

Furthermore, it is possible to disperse the stress onto the elastic structural portion due to repetition of thermal expansion of the components during operation of the lamp by disposing the holder 108 between the discharge vessel 101 and the case 106. That is to say, the stress can be dispersed at two portions between the discharge vessel 101 and the holder 108 and between the holder 108 and the case 106, so that the degradation at the engaging portion can be reduced. As a result, the decrease of the adhesion strength between the discharge vessel 101 and the case 106 can be suppressed further.

In addition, according to the structure of this embodiment, another advantage is that the degree of freedom of the shape of the discharge vessel 101 can be increased. In other words, when the discharge vessel 101 and the case 106 are directly attached or mechanically joined, the size of the case 106 is defined by the size of the high frequency power 105 that is to be housed in the case 106, and therefore the shape of the discharge vessel end 114 should be formed so as to match the diameter of the opening of the case 106. Although there is such a requirement, according to the structure of this embodiment, the degree of freedom of the shape of the discharge vessel 101 that significantly affects the discharge characteristics can be increased, because the holder 108 is present between the discharge vessel 101 and the case 106.

Figure 10A:
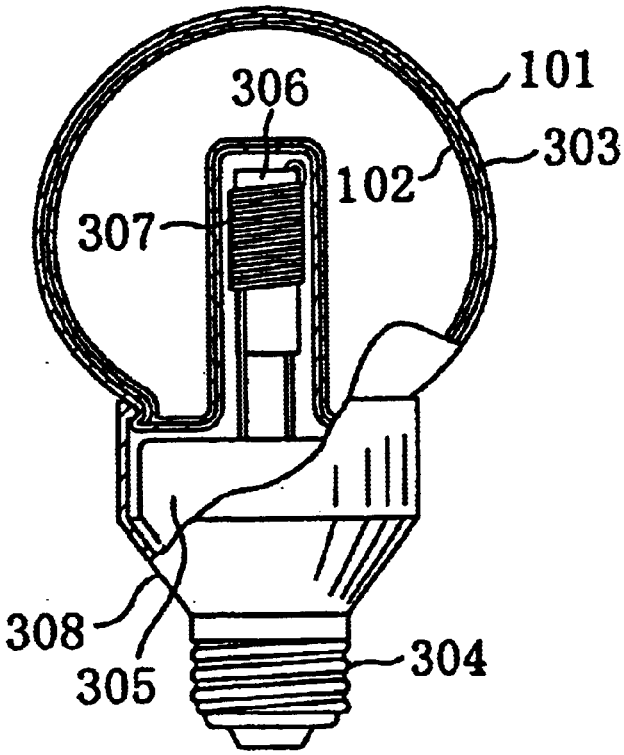
FIG. 10A Prior Art
FIG. 10A is a cross-sectional view of a conventional self-ballasted electrodeless discharge lamp.
Figure 10B:
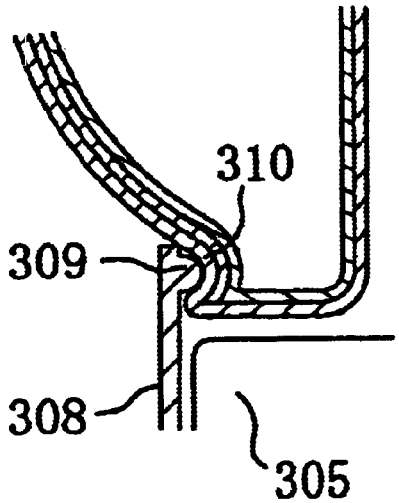
FIG. 10B Prior Art
FIG. 10B is an enlarged view of a portion where the case is in contact with the discharge vessel of the conventional self-ballasted electrodeless discharge lamp of FIG. 10A.

The discharge vessel 101 is produced by applying heat to the substantially spherical outer bulb and the cylindrical flare 113 for fusion. Therefore, when the diameter of the flare 113 to be fused is increased, the temperature distribution is unlikely to be uniform, which makes it difficult to fuse the outer bulb and the flare 113. This may cause leakage of the discharge vessel 101, leading to a reduction in the production yield. In the structure shown in FIG. 10, unless the diameter of the flare is increased, the discharge vessel 301 cannot be in contact with the case (case cover) 308, which results in an electrodeless fluorescent lamp in which leakage may occur easily and whose production yield is poor.

In order to produce an electrodeless fluorescent lamp in which leakage hardly occurs and a decrease in the production yield is suppressed, the diameter of the discharge vessel end 114 where the outer bulb of the discharge vessel 101 and the flare 113 are fused should be much smaller than that of the opening of the case 106. However, this requirement makes it difficult to directly incorporate the discharge vessel 101 to the case 106 by mechanical joining. The structure of this embodiment can solve such a problem. That is to say, the holder 108 is present between the discharge vessel 101 and the case 106, so that even if the diameter of the discharge vessel end 114 is much smaller than that of the opening of the case 106, the discharge vessel 101 can be secured easily by support in corporation of the case 106, the holder 108 and the discharge vessel 101.

In the structure of this embodiment, when the holder 108 in contact with the discharge vessel 101 is provided with a reflection function, light generated in the discharge vessel end 114 and light strayed inside the case 106 through the flare 113 is reflected to the direction of the discharge vessel 101 for effective use. As described above, in the discharge vessel 101, the substantially spherical outer bulb to which the phosphor 102 is applied and the flare 113 of the inner bulb are fused with a flame of a burner or the like. For this reason, a phosphor cannot be applied to the flare 113 or even if a phosphor is applied thereto, the phosphor in the fused portion is often detached. Therefore, the light generated in the discharge vessel 101 is leaked to the inner portion of the case 106 through the flare 113, and reflection and absorption are repeated inside the case 106 so that light is lost. The light generated in the discharge vessel end 114 covered with the case 106 is similarly leaked to the inner portion of the case 106 through the flare 113, and thus light generated in the discharge vessel 101 is wasted. Here, if the holder 108 formed of a white resin having a reflection function is used, the light generated in the discharge vessel end 114 and the light strayed inside the case 106 through the flare 113 can be reflected to the direction of the discharge vessel 101. As a result, it is possible to improve the light utilization efficiency. It is possible to provide the holder 108 with the function of reflecting the light from the discharge vessel 101 by forming a whitish resin film at least in a part of the holder 108 on the side of the discharge vessel 101 or forming a metal film or a reflection film, instead of constituting the entire holder 108 with a whitish resin.

Furthermore, the holder 108 can be provided with a magnetic field shield function. In order to provide the holder 108 with a magnetic field shield function, at least a part of the holder 108 can be made of a high permeability material, or a film or a member made of a high magnetic permeability material can be provided in a part of the holder 108. Furthermore, the holder 108 itself can be formed of a high magnetic permeability material, or powder made of a high magnetic permeability material can be dispersed in the holder 108. If a member (108 in this example) including a high magnetic permeability material is present in the vicinity of the induction coil (103 and 104) of the electrodeless fluorescent lamp, a high frequency alternating magnetic field permeates selectively through the member 108 including a high magnetic permeability material. In order words, since a high frequency alternating magnetic field permeates selectively through a material having a high magnetic permeability, the high frequency alternating magnetic field formed by the induction coil (103 and 104) permeates selectively through the member of a high magnetic permeability and becomes dense in the vicinity of the member having a high magnetic permeability. As a result, an inductive electric field generated orthogonally to the high frequency alternating magnetic field becomes intense in the vicinity of the member having a high permeability, so that the electric field that is locally intense excites krypton gas and mercury easily, so that discharge easily occurs. This means an improvement of the startability. When the holder 108 is provided with the magnetic field shield function, it is unnecessary to provide a member including a high permeability material separately, so that it is unnecessary to increase the number of components of the electrodeless fluorescent lamp and the cost-up can be suppressed. It is also possible to provide the holder 108 both with the magnetic field shield function and the reflection function as described above.

According to the structure of this embodiment, the discharge vessel 101 can be secured to the case 106 reliably, and further the light utilization efficiency can be improved so that an electrodeless fluorescent lamp having a high efficiency can be realized. That is to say, in the electrodeless discharge lamp of the embodiments of the present invention, a first shape is provided in the discharge vessel, a second shape and a third shape are provided in the holder having a reflection function, and a fourth shape is provided in the case, and the electrodeless discharge lamp of the embodiments of the present invention has a structure in which the first shape and the second shape are engaged with each other, and a structure in which the third shape and the fourth shape are engaged with each other. Therefore, the discharge vessel and the case can be secured reliably via the holder without using an adhesive such as silicone, which causes the problem that the adhesion strength caused by the detachment of the attached portion or the degradation of the adhesive due to thermal load. Furthermore, the engagement structure is provided at two portions between the discharge vessel and the holder and between the holder and the case, so that the stress onto the engagement structure caused by the thermal expansion can be dispersed and the degradation of the engaged portions also can be suppressed. Moreover, the light leaked into the case can be reflected to the inside the discharge vessel by the holder having a reflection function, and the light utilization efficiency can be improved. In addition, it is possible to improve the startability if the holder is provided with a magnetic shield function.

If the protrusion 110 of the holder 108 in contact with the discharge vessel 101 has a wedge-like shape having elasticity, the stress applied by insertion when mounting the discharge vessel 101 on the holder 108 can be reduced, so that assembling work can be performed smoothly and the discharge vessel 101 can be secured firmly to the wedge-shaped protrusion of the holder 108. Similarly, the shapes of the recess 111 and the protrusion 112 with which the holder 108 and the case 106 are engaged with each other have a wedge-like shape having elasticity, assembling work for the holder 108 and the case 106 can be performed smoothly and be secured firmly.

The above-described structure provides an electrodeless fluorescent lamp that facilitates assembling work and improves the productivity.

Next, variations of this embodiment will be described with reference to FIGS. 2 and 3.

Figure 2:
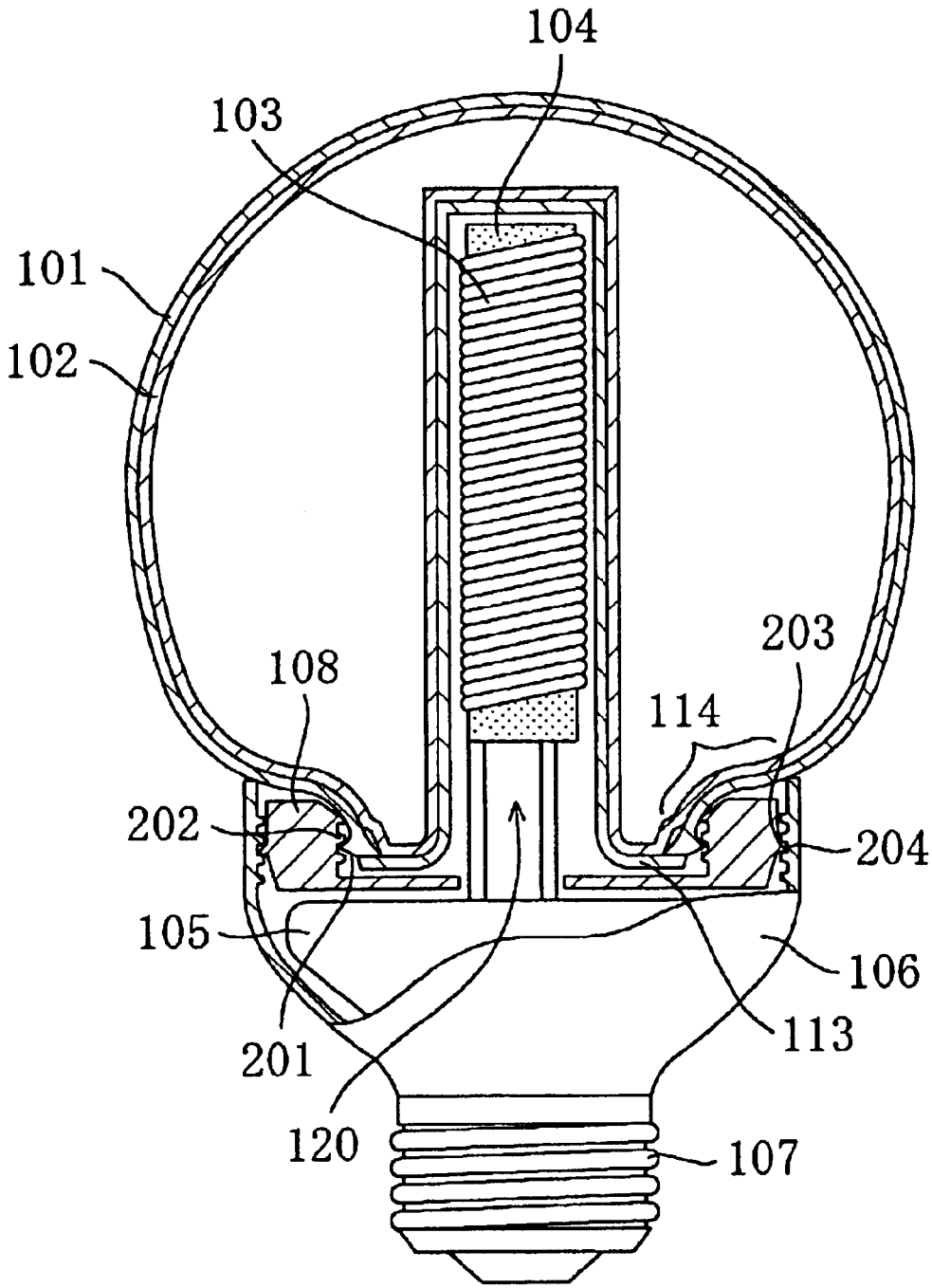
FIG. 2 is a partially cutaway cross-sectional view of an electrodeless fluorescent lamp in which first to fourth shapes are transformed of Embodiment 1 of the present invention.

FIG. 2 is a partially cutaway cross-sectional view of the electrodeless fluorescent lamp shown in FIG. 1 when the engaged portions are deformed. The same structural portions as in the electrodeless fluorescent lamp of FIG. 1 bear the same numeral and the description thereof will be omitted.

In the structure shown in FIG. 2, the discharge vessel 101 is threadingly mounted on the holder 108 provided with a thread groove 202, which is the second shape, using a protrusion 201, which is the first shape, provided in the discharge vessel 101. A protrusion 203, which is the third shape, provided in the holder 108 is threadingly mounted on a thread groove 204, which is the fourth shape, provided in the case 106.

Threadingly mounting the discharge vessel 101 on the holder 108 and threadingly mounting the holder 108 on the case 106 makes it easy to assemble the components and makes it possible to secure them firmly.

Figure 3:
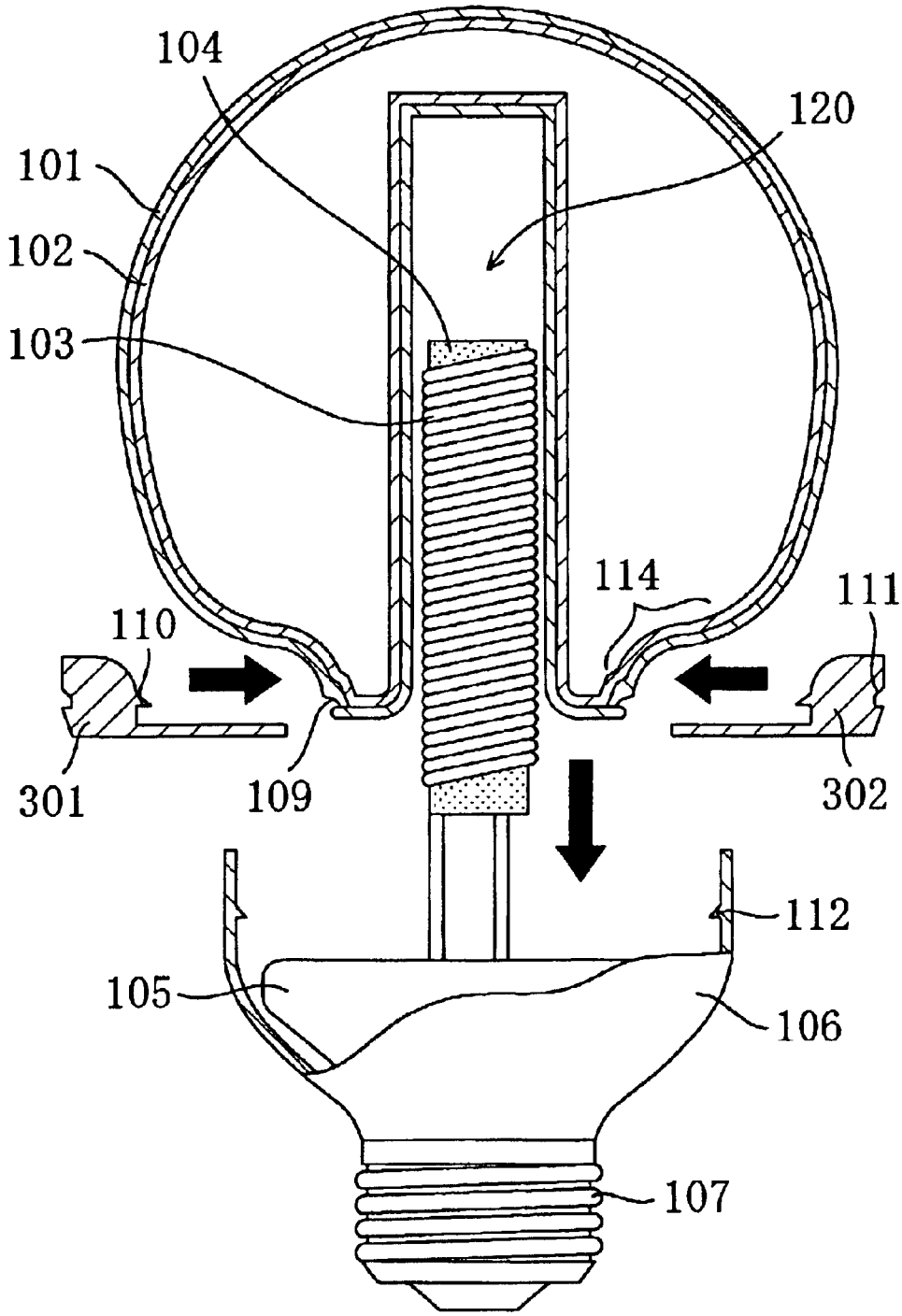
FIG. 3 is a schematic view of a method for mounting a holder of Embodiment 1 of the present invention.

FIG. 3 is a schematic view when assembling the discharge vessel 101, the holder 108 and the case 106 in the electrodeless fluorescent lamp shown in FIG. 1. The same structural portions as in the electrodeless fluorescent lamp shown in FIG. 1 bear the same numeral and the description thereof will be omitted.

The holder 108 for securing the discharge vessel 101 consists of two parts, and the parts 301 and 302 clamp the discharge vessel 101 from the opposite sides such that each part is engaged with the first shape 109 of the discharge vessel 101, and thereafter the holder is engaged with the case 106.

The holder 108 is constituted with the two parts, so that the parts 301 and 302 are mounted from the opposite sides and therefore no stress is applied to the discharge vessel 101 and mounting can be achieved easily. Furthermore, the holder 108 is clamped with the two parts, so that a small gap is formed between the parts 301 and 302, and strain due to the thermal expansion of each component caused by the heat generated during operation can be absorbed.

In this embodiment, any suitable combination of the first shape, the second shape, the third shape, and the fourth shape provided in the discharge vessel 101, the holder 108 and the case 106 can be used, as long as they are a recess or a protrusion that can be engaged with each other. The shapes of a recess and a protrusion can be combined to form either the wedge shape structure or the threading structure, or they can be combined to form both the structures. The shapes for engagement as described above is not limited to a simple recess or protrusion, but a complicated shape such as a hook, or a recess and a recess or a protrusion and a protrusion can be combined while being dislocated from each other for engagement.

In this embodiment, an example of a structure when the holder 108 is made of a white resin has been described, but the holder 108 can be made of other resin than the white resin in order to suppress a decrease of the adhesion strength of the discharge vessel 101 and the case 106. In order to improve the light utilization efficiency, the holder 108 can be made of a white resin. In addition to that, the same effect can be obtained by painting the surface of the holder 108 with a white color, treating the surface with a metal oxide such as barium sulfate or alumina, which has a high light reflectance, or providing the surface with a mirror finish.

Furthermore, in this embodiment, as the high frequency electromagnetic field generating means, a solenoid coil obtained by winding the exciting coil 103 around the ferrite core 104 and connected to the high frequency power 105 is used. However, the same effect can be obtained if a hollow coil in which the portion between the ferrite core 104 and the exciting coil 103 can be hollow, a toroidal shape, or parallel plates having external electrodes are used.

Furthermore, in this embodiment, further solid fixing can be achieved by pouring a heat resistant adhesive such as silicone into gap portions between the discharge vessel 101 and the holder 108 and between the holder 108 and the case 106.

In this embodiment, an electrodeless fluorescent lamp has been described, but the same effect can be obtained without the phosphor layer.

Embodiment 2

Figure 4:
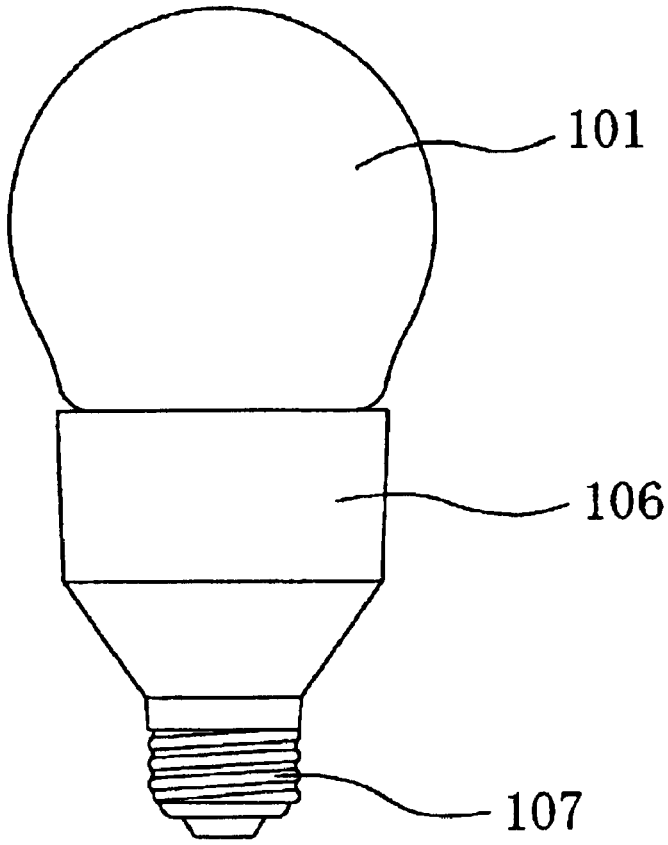
FIG. 4 shows an appearance of an electrodeless fluorescent lamp of Embodiment 2 of the present invention.
Figure 5:
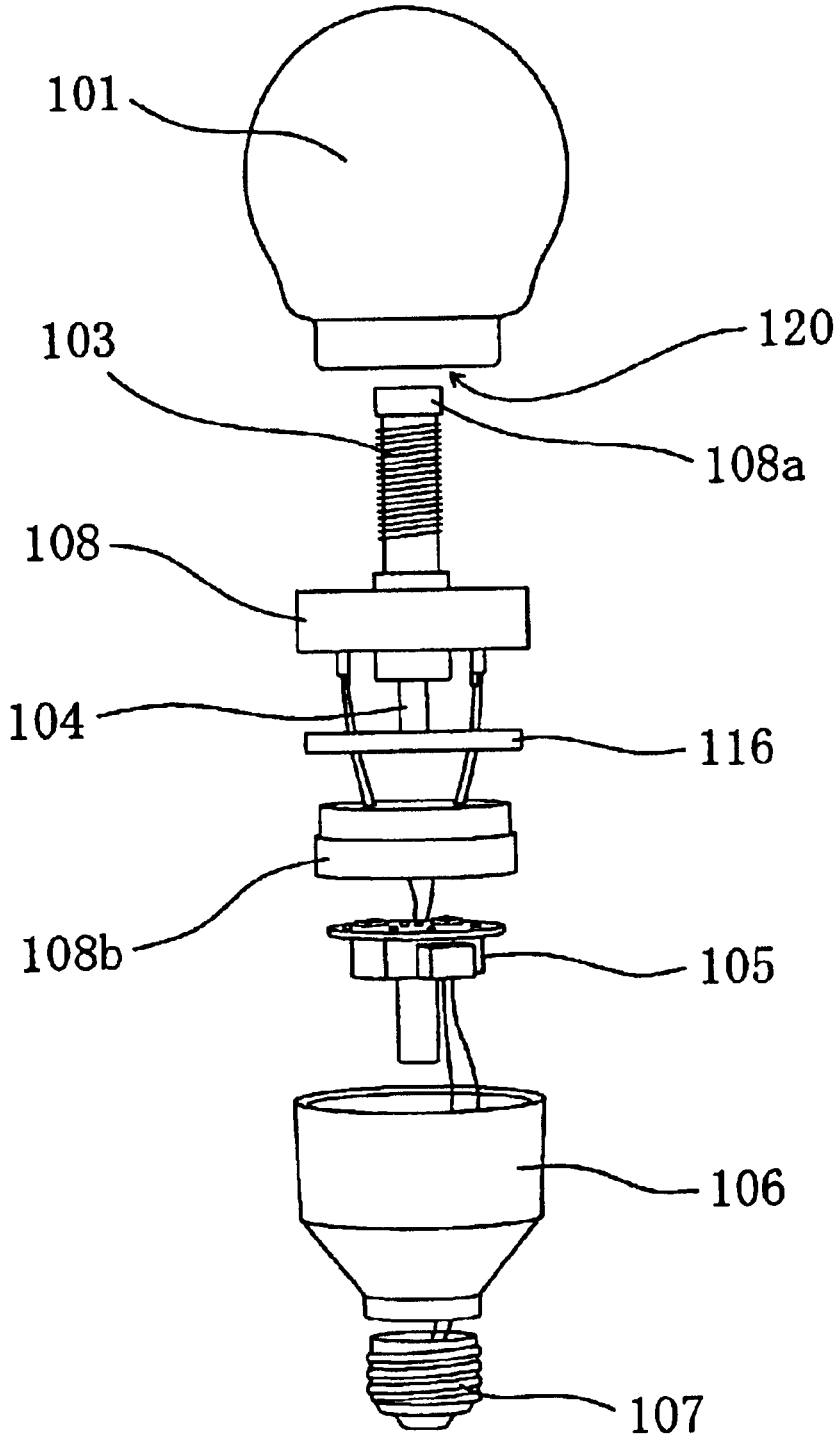
FIG. 5 is an exploded view of the electrodeless fluorescent lamp of Embodiment 2 of the present invention.

An electrodeless fluorescent lamp of Embodiment 2 of the present invention will be described with reference to FIGS. 4 to 8. FIG. 4 is a view showing an appearance of an electrodeless fluorescent lamp of this embodiment, and FIG. 5 is an exploded view for illustrating the structure of the electrodeless fluorescent lamp of this embodiment.

From the appearance of the electrodeless fluorescent lamp of this embodiment, it includes a discharge vessel 101, a case 106 and a lamp base 107 as in the electrodeless fluorescent lamp of Embodiment 1. The electrodeless fluorescent lamp of this embodiment is the same as Embodiment 1 in the aspect that the discharge vessel 101 and the holder 108 are engaged, and the holder 108 and the case 106 are engaged. The structure of this embodiment is very different from Embodiment 1 in that an induction coil bobbin portion 108*a* is formed on the holder 108 to which the discharge vessel 101 is secured. Other aspects are basically the same as those in Embodiment 1, so that the description thereof will be omitted. A threading structure is provided at one end of the case 106, and the lamp base 107 having a corresponding threading structure can be attached to that end of the case 106.

An exciting coil (winding) 103 is wound around the induction coil bobbin portion 108*a* on its surface, and is a cylinder into which a core 104 is inserted, and portions (holder main body) that engages with the discharge vessel 101 and the case 106 and the induction coil bobbin portion 108*a* are integrally formed. In this embodiment, the holder main body and the induction coil bobbin portion 108*a* are formed integrally with a resin, and the holder 108 is prepared as a holder provided with a bobbin.

When the holder provided with a bobbin is used as the holder 108, the holder 108 including the induction coil bobbin portion 108*a* wound with the exiting coil 103 can be inserted into the cavity 120 of the discharge vessel 101, and merely inserting the ferrite core 104 to the cylinder of the induction coil bobbin portion 108*a* allows the exiting coil 103 and the ferrite core 104 to be arranged in the cavity 120. Thus, the electrodeless fluorescent lamp can be assembled in a simple manner. Furthermore, since the bobbin 108*a* and the discharge vessel 101 are secured to each other firmly, the relative positions of the induction coil (103 and 104) and the discharge vessel 101 can be constant, even if vibration occurs. Moreover, since the induction coil bobbin portion 108*a* is formed integrally with the holder main body, an increase in the number of components can be avoided.

In this embodiment, one end of the core 104 is positioned in the case 106, and the a heat sink 116 is provided in that end portion of the core 104. The heat sink 116 is, for example, a plate member having comparatively good thermal conductivity (metal plate, ferrite disk, etc.). It is possible to suppress an increase of the temperature of the core 104 by attaching the heat sink 116 to the core 104. If the temperature of the core 104 exceeds the Curie temperature, it no longer serves as a magnetic material, so that the role of heat release of the heat sink 116 can be important.

Furthermore, in this embodiment, the holder 108 includes a circuit holder portion 108*b* on which a ballast (high frequency power) 105 is placed, and the circuit holder portion 108*b* on which a ballast (high frequency power) 105 is placed is secured to the holder main body That is to say, in this embodiment, the ballast 105 is placed on a part of the holder 108, and the holder 108 is secured to the case 106 and the discharge vessel 101 by engagement, so that even if vibration occurs, the ballast 105 is prevented from moving in the case 106. As a result, for example, even if vibration occurs when the electrodeless fluorescent lamp is transported, the malfunction of the ballast 105 due to the vibration can be prevented.

It is sufficient that the electrodeless fluorescent lamp of this embodiment also has a combination structure in which the a part of the discharge vessel 101 and a first portion of the holder 108 are engaged with each other as in Embodiment 1, and a second portion of the holder and a part of the case 106 are engaged with each other. However, if it has an engagement structure shown in FIGS. 6 and 7, it is convenient especially when assembling the electrodeless fluorescent lamp.

Figure 6:
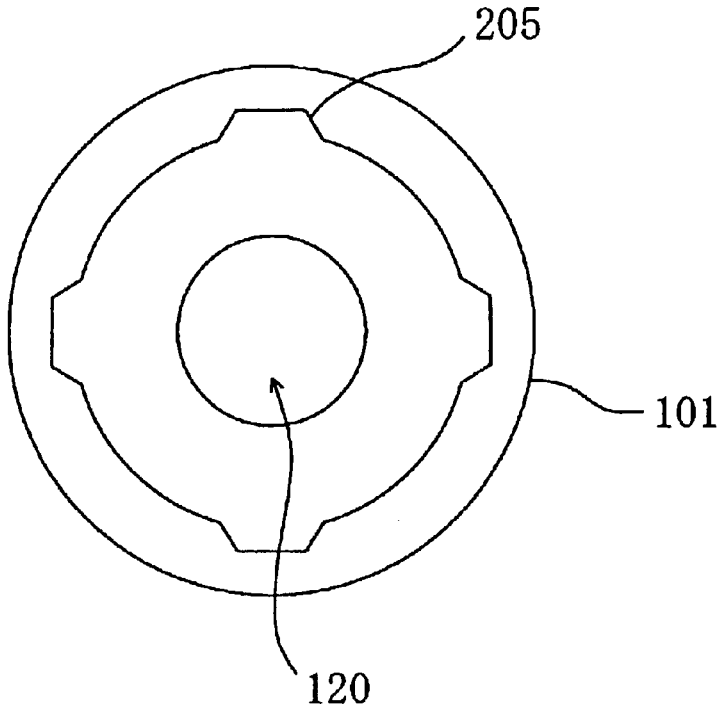
FIG. 6 is a bottom view of a discharge vessel of Embodiment 2 of the present invention.
Figure 7:
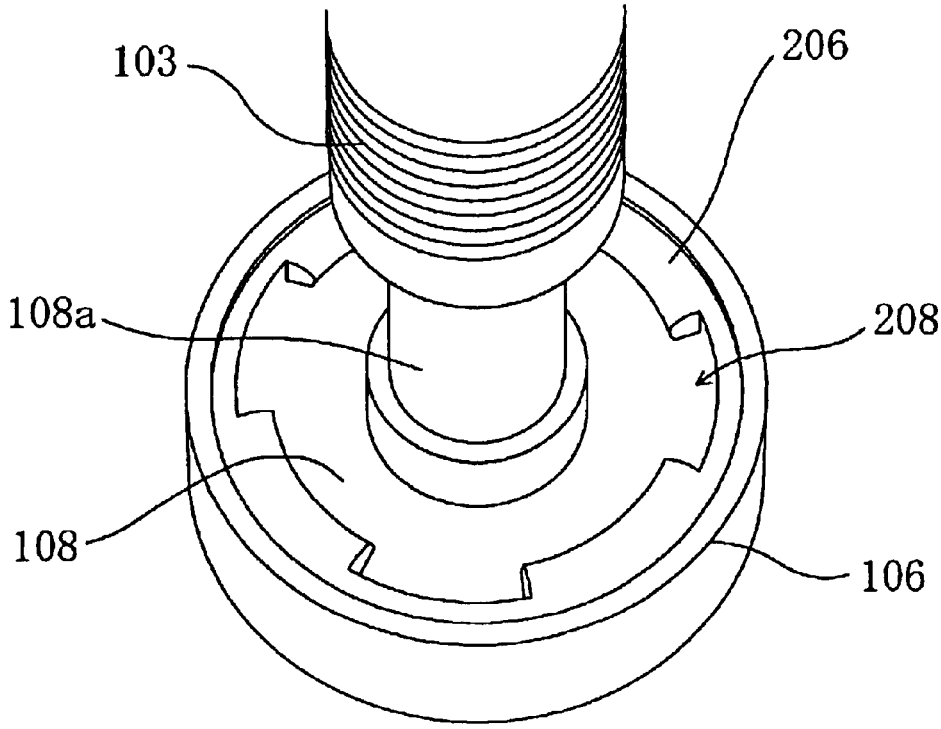
FIG. 7 is a perspective view of a holder mounted in a case of Embodiment 2 of the present invention.

FIG. 6 is a view taken from the bottom of the discharge vessel 101, and FIG. 7 is a perspective view of the holder 108 mounted on the case 106 taken from the side of the discharge vessel 101.

As shown in FIG. 6, a protrusion (or projection) 205 (four protrusions in this example) are provided in a part of the bottom of the discharge vessel 101. The protrusions 205 extend in a direction substantially perpendicular to the direction into which the induction coil (especially the ferrite core 104) is inserted. On the other hand, a recess 206 that clamps the protrusion 205 and has a U-shaped cross section is formed in the holder 108, as shown in FIG. 7. A notched portion 208 having a size that allows the protrusion 205 to move downward is provided in the periphery of the recess 206 of the holder 108. In this structure, after inserting the protrusions 205 of the discharge vessel 101 into the notched portion 208 of the holder 108, the discharge vessel 101 is rotated around the cavity 120 as the central axis. Thus, the protrusions 205 can be engaged with the recess 206 in a simple manner. Therefore, the efficiency of the assembly work can be improved. When the holder 108 has such an engagement structure, or when the holder 108 has a threading groove structure, there is an advantage that the risk that the discharge vessel 101 falls down in the vertical direction can be prevented more reliably when the electrodeless fluorescent lamp is used as a downlight.

Figure 8A:
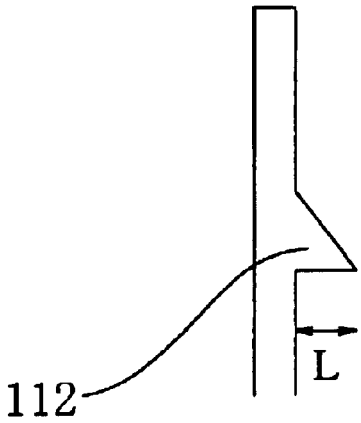
FIG. 8A is a side view showing the shape of a wedge-shaped recess.
Figure 8B:
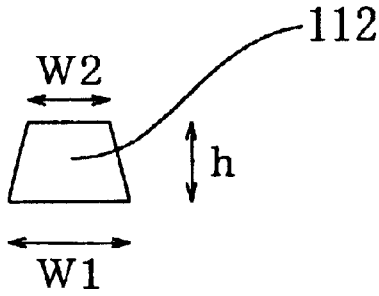
FIG. 8B is a front view showing the shape of the wedge-shaped recess.

In this embodiment, the holder 108 and the case 106 can be secured to each other by engaging the recess 111 of the holder 108 with the wedge shaped recess 112 provided on the inner wall of the case 106 as in Embodiment 1. The threading groove structure may be used, but in this case, it is necessary to rotate the holder 108 on which the ballast 105 is placed, if dosing so, wiring for electrically connecting the ballast 105 to other components is twisted. In order to avoid such a twist of wiring, in this embodiment, the recess 111 of the holder 108 is engaged with the wedge shaped protrusion 112 provided on the inner wall of the case 106 so as to be secured thereto. Illustrative sized of the wedge shaped protrusion 112 in this embodiment is shown in FIG. 8. The length L of the bottom of the protrusion 112 is 0.6 mm, the width of the lower side W1 and the width W2 are 6.0 mm and 5.0 mm, respectively. The height h is 2.5 mm.

Preferred embodiments of the present invention have been described. However, the description as above is not limiting the present invention, but various variations are possible.

Figure 9A:
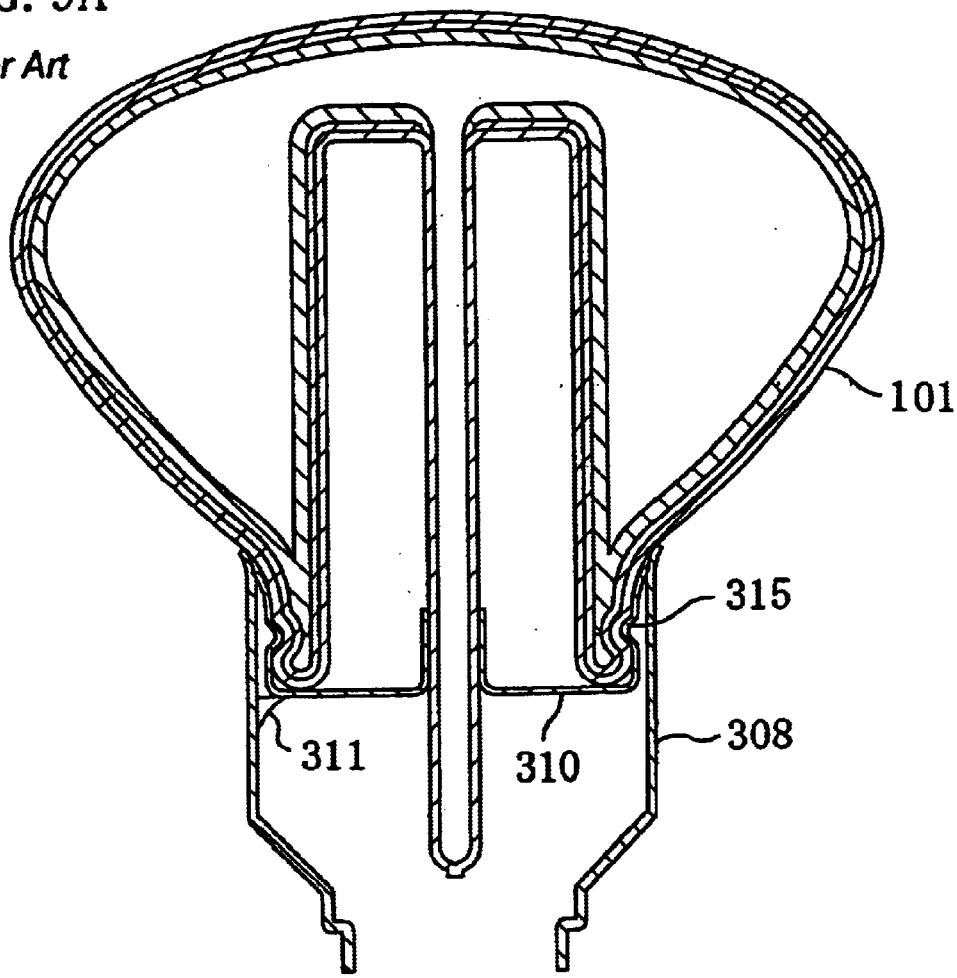
FIG. 9A Prior Art
FIG. 9A is a cross-sectional view of a conventional self-ballasted electrodeless discharge lamp.
Figure 9B:
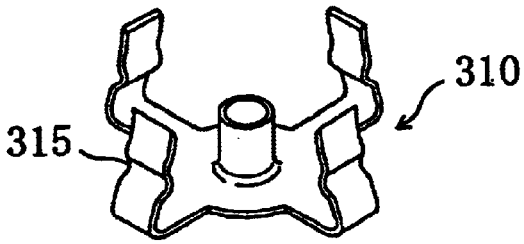
FIG. 9B Prior Art
FIG. 9B is a perspective view of a bulb attachment clip 310 of the conventional self-ballasted electrodeless discharge lamp of FIG. 9A.

An example of a known technique (bulb attachment structure) that has been developed in the contact relationship between the discharge vessel and the case is Japanese Laid-Open Patent Publication (Tokuhyo) No. 8-511650 (International Publication No. WO95/27995). FIG. 9A is a cross-sectional view showing the electrodeless discharge lamp disclosed in the publication, and FIG. 9B is a perspective view showing a bulb attachment clip 310.

In the case of the electrodeless fluorescent lamp shown in FIG. 9, the end of a curved arm 315 of the clip 310 is in contact with a case 308, and the arm 315 is in contact with the discharge vessel 301. The clip 310 is supported by a stopper 311 so as to prevent the discharge vessel 301 from falling down.

As seen from FIG. 9, the electrodeless discharge lamp shown in FIG. 9 employs the clip 310, but is different from the electrodeless discharge lamp of the embodiments of the present invention in that this structure is not a combination structure in which a part of the discharge vessel and the first portion of the holder are engaged with each other, and the second portion of the holder and a part of the case are engaged with each other. When this is used as an uplight, the stopper 311 prevents the discharge vessel 101 from moving downward, but when it is used as a downlight, if an unexpected shock is applied to the electrodeless discharge lamp, it hardly ensures that this structure absolutely prevent the discharge vessel 101 from falling down in the vertical direction. Furthermore, this publication fails to describe nor suggest the holder with a bobbin or the holder including a circuit holder.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A self-ballasted electrodeless discharge lamp comprising:

a discharge vessel having a cavity;

an induction coil that is inserted into the cavity;

a ballast for supplying power to the induction coil;

a case for covering the ballast; and a lamp base provided in the case, wherein the discharge vessel is secured to the case via a holder, said holder being disposed within the confines of the case, a part of the discharge vessel and a first portion of the holder are engaged with each other to constitute a combination structure, and a second portion of the holder and a part of the case are engaged with each other to constitute a combination structure; and wherein the part of the discharge vessel is a protrusion extending to a second direction substantially perpendicular to a first direction, the induction coil being inserted in the first direction, the first portion of the holder is a recess that clamps the protrusion and has a substantially U-shaped cross section, a notched portion having a size that allows the protrusion to move in a direction substantially perpendicular to the second direction is provided in a periphery of the recess of the holder, the holder has an engagement structure that allows the protrusion to be engaged with the recess by inserting the protrusion of the discharge vessel to the notched portion of the holder, and then rotating the discharge vessel around a portion into which the induction coil is inserted.

2. The self-ballasted electrodeless discharge lamp according to claim 1, wherein at least a part of the holder on a side of the discharge vessel has a function of reflecting light from the discharge vessel.

3. The self-ballasted electrodeless discharge lamp according to claim 1, wherein at least a part of the holder has a function of shielding a magnetic field from the discharge vessel.

4. A self-ballasted electrodeless discharge lamp comprising:

a discharge vessel having a cavity;

an induction coil that is inserted into the cavity;

a ballast for supplying power to the induction coil;

a case for covering the ballast; and a lamp base provided in the case, wherein the discharge vessel is secured to the case via a holder, said holder being disposed within the confines of the case, the induction coil includes a core and a winding;

the holder has a cylindrical bobbin portion whose surface is wound with the winding and into which the core is inserted, a part of the discharge vessel and a first portion of the holder are engaged with each other to constitute a combination structure, and a second portion of the holder and a part of the case are engaged with each other to constitute a combination structure; and wherein the part of the discharge vessel is a protrusion extending to a second direction substantially perpendicular to a first direction, the induction coil being inserted in the first direction, the first portion of the holder is a recess that clamps the protrusion and has a substantially U-shaped cross section, a notched portion having a size that allows the protrusion to move in a direction substantially perpendicular to the second direction is provided in a periphery of the recess of the holder, the holder has an engagement structure that allows the protrusion to be engaged with the recess by inserting the protrusion of the discharge vessel to the notched portion of the holder, and then rotating the discharge vessel around a portion into which the induction coil is inserted.

5. The self-ballasted electrodeless discharge lamp according to claim 4, wherein a first end of the core is positioned in the case, and a heat sink is provided in the first end of the core.

6. A self-ballasted electrodeless discharge lamp comprising:

a discharge lamp having a cavity;

an induction coil that is inserted into the cavity;

a ballast for supplying power to the induction coil;

a case for covering the ballast; and a lamp base provided in the case, wherein the discharge vessel is secured to the case via a holder, said holder being disposed within the confines of the case, a part of the discharge vessel and a first portion of the holder are engaged with each other to constitute a combination structure, a second portion of the holder and a part of the case are engaged with each other to constitute a combination structure; and the holder has a circuit holder portion on which the ballast is placed; and wherein the part of the discharge vessel is a protrusion extending to a second direction substantially perpendicular to a first direction, the induction coil being inserted in the first direction, the first portion of the holder is a recess that clamps the protrusion and has a substantially U-shaped cross section, a notched portion having a size that allows the protrusion to move in a direction substantially perpendicular to the second direction is provided in a periphery of the recess of the holder, the holder has an engagement structure that allows the protrusion to be engaged with the recess by inserting the protrusion of the discharge vessel to the notched portion of the holder, and then rotating the discharge vessel around a portion into which the induction coil is inserted.

7. The self-ballasted electrodeless discharge lamp according to claim 6, wherein the induction coil includes a core and a winding, the holder has a cylindrical bobbin portion whose surface is wound with the winding and into which the core is inserted, a first end of the core is positioned in the case, and a heat sink is provided in the first end of the core.

8. The self-ballasted electrodeless discharge lamp according to claim 1, 4, or 6, wherein the second portion of the holder is a protrusion, and a part of the case is a wedge shaped portion that supports the protrusion after the protrusion of the holder is inserted to a direction opposite to the discharge vessel.

* * * * *